US010131995B2

(12) United States Patent
Li et al.

(10) Patent No.: US 10,131,995 B2
(45) Date of Patent: Nov. 20, 2018

(54) PREPARATION METHOD OF LOW-PH CONTROLLED-RELEASE INTELLIGENT CORROSION INHIBITOR

(71) Applicant: UNIVERSITY OF SCIENCE AND TECHNOLOGY BEIJING, Beijing (CN)

(72) Inventors: Xiaogang Li, Beijing (CN); Chaofang Dong, Beijing (CN); Xuequn Cheng, Beijing (CN); Cuiwei Du, Beijing (CN); Kui Xiao, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 386 days.

(21) Appl. No.: 14/997,290

(22) Filed: Jan. 15, 2016

(65) Prior Publication Data

US 2016/0208165 A1 Jul. 21, 2016

(30) Foreign Application Priority Data

Jan. 21, 2015 (CN) ..... 2015 1 0030747

(51) Int. Cl.

| | |
|---|---|
| ***C09K 15/30*** | (2006.01) |
| ***C23F 11/00*** | (2006.01) |
| ***C23F 11/10*** | (2006.01) |

(52) U.S. Cl.

CPC ..... *C23F 11/00* (2013.01); *C23F 11/10* (2013.01)

(58) Field of Classification Search

CPC ..... C09K 15/30

See application file for complete search history.

(56) References Cited

U.S. PATENT DOCUMENTS 5,223,313 A * 6/1993 Holzer ..... B32B 17/10311 428/192
6,444,595 B1 * 9/2002 Elkouh ..... B32B 5/16 442/76

(Continued)

FOREIGN PATENT DOCUMENTS

CN 103031559 A * 4/2013
CN 104593779 A 5/2015

OTHER PUBLICATIONS

CN 103031559 A. An English Translation.*

*Primary Examiner* — Nicole M. Buie-Hatcher
*Assistant Examiner* — Mohammad Reza-Asdjodi
(74) *Attorney, Agent, or Firm* — Seed Intellectual Property Law Group LLP

(57) ABSTRACT

This disclosure relates to a preparation method of a low-pH controlled-release intelligent corrosion inhibitor. The low-pH controlled-release intelligent corrosion inhibitor comprises a hydrogel with low pH responsiveness and a corrosion inhibiting substance having the capacity of corrosion inhibition. That is, a corrosion inhibiting substance is wrapped in a low-pH sensitive hydrogel. The swelling degree of the pH sensitive hydrogel may be changed according to the amounts of monomers and crosslinking agents so as to control the releasing speed of the corrosion inhibiting substance. By the soaking experiment and the measurements of electrochemical polarization curves and alternating impedance spectra, the sensitive and long-lasting features of the low-pH controlled-release intelligent corrosion inhibitor are indicated. Therefore, the advantageous effects of this disclosure lies in that: 1) the system enables the releasing speed of the corrosion inhibiting substance to be controlled by pH; 2) the system enables long-lasting effect and high (Continued)

corrosion inhibition efficiency of the corrosion inhibiting substance; and 3) the system has broad applicability.

4 Claims, 6 Drawing Sheets

(56) References Cited

U.S. PATENT DOCUMENTS

| | | | | |
|---|---|---|---|---|
| 2004/0253294 | A1* | 12/2004 | Tabata | A61K 9/0019 424/426 |
| 2008/0096784 | A1* | 4/2008 | Barg | C11D 3/0073 510/161 |
| 2009/0149599 | A1* | 6/2009 | Shibutani | C09D 129/04 525/56 |
| 2010/0233146 | A1* | 9/2010 | McDaniel | A01N 63/02 424/94.2 |
| 2011/0217761 | A1* | 9/2011 | Hilgren | A62D 3/02 435/262 |
| 2016/0208165 | A1* | 7/2016 | Li | C23F 11/00 |

* cited by examiner

PREPARATION METHOD OF LOW-PH CONTROLLED-RELEASE INTELLIGENT CORROSION INHIBITOR

FIELD OF THE INVENTION

This disclosure belongs to the field of the preparation of intelligent corrosion inhibitors, and particularly, relates to a preparation method of a low-pH controlled-release intelligent corrosion inhibitor.

BACKGROUND OF THE INVENTION

The corrosion problems of metal materials exist throughout various fields of domestic economy. Most metal materials have corrosion problems under acidic condition. The existing protecting measures for metal material corrosion mainly include improvement of structures and properties of materials themselves, plating, surface treatment such as painting, etc., control of ambient conditions where materials are used, cathode protection, usage of corrosion inhibitors, etc. Among these, corrosion inhibitors have various advantages of broad applicability, simple packaging process, low cost, long antirust period, good appearance, low energy consumption, etc., and has been widely used. However, the usage manner of one-time feeding or continual feeding is typically used in the conventional corrosion inhibitors. In initial period of use, the concentration of the corrosion inhibitor is very high, which may result in the waste of the corrosion inhibitor; as the time passes by, the corrosion inhibitor will encounter problems such as hydrolysis, degradation, deactivation, etc in service environment, which result in the reduction of corrosion inhibition effect. Therefore, in recent years, the researches have been devoted to develop an intelligent long-lasting sustained-release agent, which is desired to be capable of automatically controlling the release amount of a corrosion inhibitor according to the variation of the ambient environment. It is a direction of investigation and development of intelligent corrosion inhibitors to prepare an intelligent corrosion inhibitor by using a non-toxic and pH sensitive hydrogel as a carrier.

The sensitivity of the pH sensitive hydrogel comes from the ionizable groups, such as a carboxyl group, an amino group, etc., carried on the molecular chain thereof. These groups are subject to ionization or protonation under a certain pH condition and are positively or negatively charged. The mutual repelling between the same charges results in the change of swelling of hydrogel, represented by the pH sensitivity of hydrogel. As for a pH sensitive aqueous gel bearing a weakly basic group (typically an amino group), when the pH value of an ambient medium reaches to a specific value, the weakly basic group on the side chain of the molecular chain of the hydrogel is protonated to form an electrically charged cation. The repulsive force between the same kind of ions increases, and thereby the swelling of the hydrogel occurs. As for a pH sensitive hydrogel bearing a weakly acidic group, when the pH value of an ambient medium is greater than a specific value, the swelling of the hydrogel occurs.

The magnitude of swelling degree of the pH sensitive hydrogel under different ambient pH conditions is an important performance indication of this intelligent corrosion inhibitor. At a certain pH value, as the swelling degree of the hydrogel is larger, the releasing rate of the corrosion inhibiting substance is faster.

Since most metal materials have corrosion problems under acidic condition, it is very important to investigate an intelligent corrosion inhibitor, which can be released rapidly in a large amount under an acidic condition while can be released slowly in a small amount under a neutral or basic condition. Among various materials containing weakly basic groups, chitosan is a natural basic polysaccharide, which bears an amino group on $C_2$ of the structural unit thereof, and is suitable for the preparation of the low-pH sensitive intelligent hydrogel required by intelligent corrosion inhibitors.

SUMMARY OR THE INVENTION

The technical problem to be solved by this disclosure is to provide a preparation method of a low-pH controlled-release intelligent corrosion inhibitor. This method has simple process, low cost, and broad application. The long-lasting intelligent corrosion inhibitor prepared has good corrosion inhibition effect and good prospect for application.

In order to solve existing problems, the technical solution provided by this disclosure is that:

a preparation method of a low-pH controlled-release corrosion inhibitor, comprising the steps of:

(a) dissolving a monomer in an aqueous solution of an acidic medium with a mass fraction of 0.5-1.0% to prepare a monomer-acidic medium aqueous solution wherein said monomer has a mass fraction of 1.2%-1.8%, then adding an aqueous solution of a crosslinking agent with a mass fraction of 1%-2% to said monomer-acidic medium aqueous solution, and stirring and reacting, wherein said monomer is chitosan, said acidic medium is acetic acid, and said crosslinking agent is glutaraldehyde;

(b) cooling, washing, freezing, and drying the product prepared in step (a) to obtain a pH-responsive hydrogel; and (c) adding said pH-responsive hydrogel into an aqueous solution of a corrosion inhibiting substance having a concentration of 1-5 mg/mL, and then lyophilizing in vacuum to prepare said low-pH controlled-release corrosion inhibitor, wherein said corrosion inhibiting sub stance is benzotriazole.

Preferably, said step (a) comprises:

formulating the aqueous solution of said acidic medium with a mass fraction of 0.5-1.0%, then dissolving said monomer in said aqueous solution, uniformly stirring and standing to prepare a monomer-acidic medium aqueous solution wherein said monomer has a mass fraction of 1.2%-1.8%, then adding an aqueous solution of the crosslinking agent with a mass fraction of 1%-2% into said monomer-acidic medium aqueous solution, continuously stirring the obtained mixture at a speed of 1000-1500 rotations/min for 20-30 min, and reacting at 30-35° C. for 24-28 h.

Preferably, said step (b) comprises:

cooling the product prepared in step (a) to room temperature, then washing the product with ethanol and deionized water, freezing the washed product at −25 to −20° C. for 24-28 h, and then lyophilizing in vacuum to a constant weight, to obtain the pH-responsive hydrogel.

Preferably, said step (c) comprises:

adding said pH-responsive hydrogel into the aqueous solution of said corrosion inhibiting substance having a concentration of 1-5 mg/mL, soaking for 2-3 days, freezing at −25 to −20° C. for 24-28 h, and then lyophilizing in vacuum to a constant weight, to prepare said low-pH controlled-release corrosion inhibitor.

Preferably, said low pH is 2-5.

Specifically, this disclosure provides a preparation method of a low-pH controlled-release intelligent corrosion inhibitor, characterized in that said low-pH controlled-release intelligent corrosion inhibitor is prepared from a monomer with a mass fraction of 1.2%-1.8%, a crosslinking agent with a mass fraction of 1%-2%, an acidic medium with a mass fraction of 0.7%, and a corrosion inhibitor with a content of 1-5 mg/mL and deionized water, said monomer is chitosan, said crosslinking agent is glutaraldehyde, said acidic medium is acetic acid, and said corrosion inhibiting substance is benzotriazole (BTA), and the preparation method thereof comprises the steps of:

1) Preparation of a pH-Responsive Hydrogel (a) formulating an acetic acid solution with a mass fraction of 0.7% in a beaker, dissolving a monomer in this solution, and uniformly stirring and standing to formulate a monomer-acetic acid solution with a mass fraction of 1.2%-1.8%; adding an aqueous crosslinking agent solution with a mass fraction of 1%-2% thereto, continuously stirring at a speed of 500 rotations/min for 30 min, and then reacting at 30° C. for 24 h, (b) cooling the product to room temperature after completion of the reaction, and cleaning the product with ethanol and deionized water; placing the washed product in a freezer compartment of a refrigerator, freezing at −24° C. for 24 h, transferring the product to a vacuum freeze-dryer, lyophilizing in vacuum to a constant weight, to obtain a pH-responsive hydrogel;

2) Preparation Method of a Low-pH Controlled-Release Intelligent Corrosion Inhibitor dissolving said pH-responsive hydrogel in an aqueous corrosion inhibitor solution with a concentration of 1-5 mg/mL, said corrosion inhibiting substance being benzotriazole (BTA), placing the product in a freezer compartment of a refrigerator after soaking for 2 days, freezing at −24° C. for 24 h, transferring to a freeze-dryer, lyophilizing in vacuum to a constant weight, to obtain a long-lasting intelligent corrosion inhibitor releasable under controlled pH.

Principle: $C_2$ of chitosan bears an amino group which can be subject to Schiff base reaction with an aldehyde group to form a pH sensitive hydrogel by crosslinking. Unreacted amino groups present in the hydrogel are prone to be protonated under an acidic condition so as to allow the increase of the swelling degree thereof. In the process of entrapping a BTA corrosion inhibiting substance, the pH sensitive hydrogel absorbs the aqueous BTA solution to allow for swelling, and BTA absorbed by the pH sensitive hydrogel remains in the structure of a dry gel after freeze drying to achieve an intelligent corrosion inhibitor. In the process of releasing chemicals, BTA in the intelligent corrosion inhibitor dissolves in a solution entering the structure of the hydrogel and flows out of the intelligent corrosion inhibitor therewith. Under an acidic condition, the swelling degree of the pH sensitive hydrogel is larger, the flow rate of the solution is promoted, and the chemical releasing speed of BTA is improved.

With respect to the low-pH controlled-release intelligent corrosion inhibitor prepared in this disclosure, the magnitude of swelling degree of the pH sensitive hydrogel may be changed according to the usage amount of monomers and crosslinking agents and the pH value of ambient media so that the entrapment amount and the releasing amount of the corrosion inhibitor can be controlled.

Advantageous Effects of this Disclosure (1) this invention has simple process and low cost, and does not produce toxic or harmful byproducts and is environment-friendly by using water as a reaction medium in the process of preparation; and (2) the low-pH controlled-release intelligent corrosion inhibitor prepared in this invention has good pH responsiveness to ambient media, high corrosion inhibition efficiency, and good prospect for application.

DETAILED DESCRIPTION OF THE INVENTION

This disclosure is further elaborated below in conjunction with specific Examples. It is to be understood that these examples are provided to illustrate this disclosure but are not intended to limit the scope of this disclosure. Furthermore, after reading the contents taught by this disclosure, various variations and modifications may be performed on this disclosure by the person skilled in the art, and these equivalents also fall into the scope defined by the appended claims of this application.

Example 1

1) Preparation of a pH-Sensitive Hydrogel a) 0.35 g of acetic acid was dropped into a beaker, 50 g deionized water was added, 0.6 g of chitosan powder was added with magnetically stirring at a speed of 500 r/min, and stirring was kept until being uniform followed by standing for 1 h to formulate an acetic acid solution of chitosan with a mass fraction of 1.2%. 25 g of an aqueous glutaraldehyde solution with a mass fraction of 1% was formulated, and transferred to the acetic acid solution of chitosan with magnetically stirring at a speed of 500 r/min, and the product was stirred for 30 min, and then placed in an oven at 30° C. for reaction by standing for 24 h.

b) After completion of the reaction, the product was cleaned with ethanol and deionized water, transferred to a freezer compartment of a refrigerator, frozen at −24° C. for 24 h, and immediately transferred to a vacuum lyophilizing oven, and then vacuum freeze-dried.

2) Preparation of a Low-pH Controlled-Release Intelligent Corrosion Inhibitor

About 0.8 g of the dry gel described above was taken and was soaked in 200 ml of an aqueous solution containing a BTA corrosion inhibiting substance with a BTA concentration of 5 g/L. After standing for 48 h, redundant aqueous BTA solution was removed, and the hydrogel carrying the corrosion inhibitor was cleaned with deionized water. After completion of cleaning, the product was transferred to a freezer compartment of a refrigerator, frozen at −24° C. for 24 h, immediately transferred to a vacuum lyophilizing oven, and vacuum freeze-dried, and then preserved by sealing for stand-by.

Figure 1:
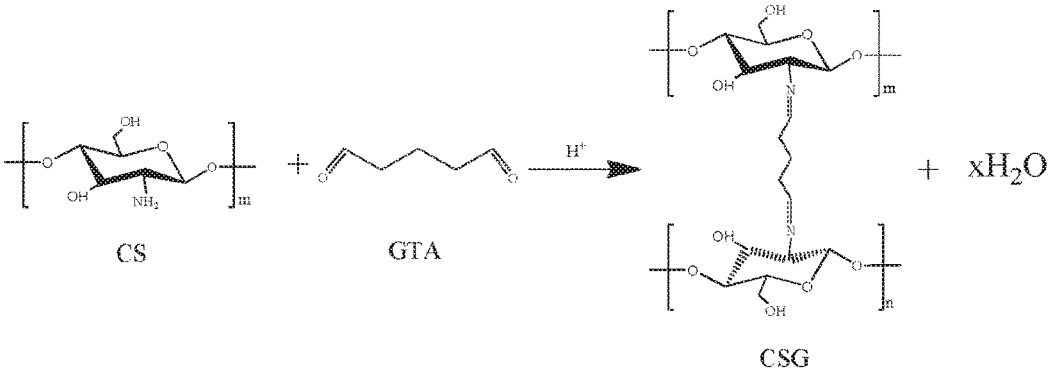
FIG. 1 is a theoretical synthetic scheme of the pH sensitive hydrogel in the prepared low-pH controlled-release intelligent corrosion inhibitor.
Figure 2:
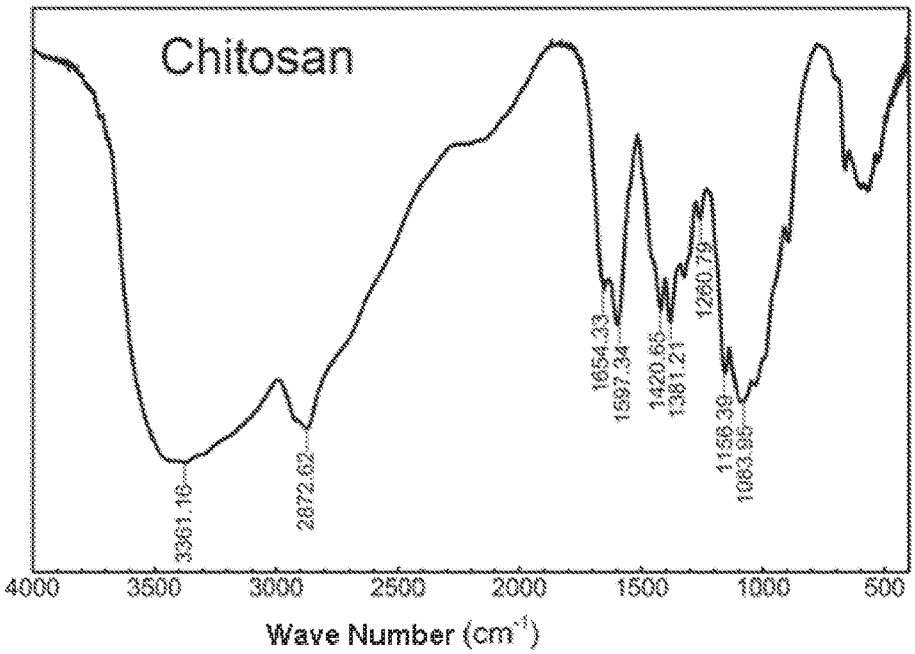
FIG. 2 is an infrared spectrogram of chitosan powder used in the prepared low-pH controlled-release intelligent corrosion inhibitor, in which its infrared characteristic absorption peaks ($cm^{-1}$) are: 3361.16, 2872.62, 1654.33, 1597.34, 1420.65, 1381.21, 1260.79, 1156.39, 1083.95.
Figure 3:
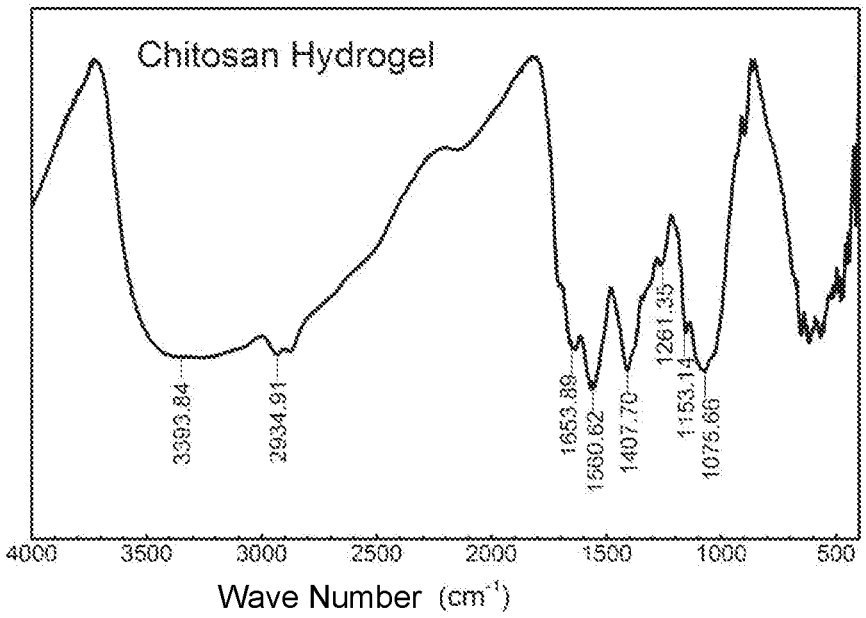
FIG. 3 is an infrared spectrogram of the pH sensitive hydrogel in the prepared low-pH controlled-release intelligent corrosion inhibitor, in which its infrared characteristic absorption peaks ($cm^{-}$) are: 3393.84, 2934.91, 1653.89, 1560.62, 1407.70, 1261.35, 1153.14, 1075.66. The usage amounts of the monomer and the crosslinking agent does not greatly affect the infrared spectrogram of the pH sensitive hydrogel, and therefore the infrared spectrograms of various Examples are exemplified by FIG. 3 and are not enumerated one by one.
Figure 4:
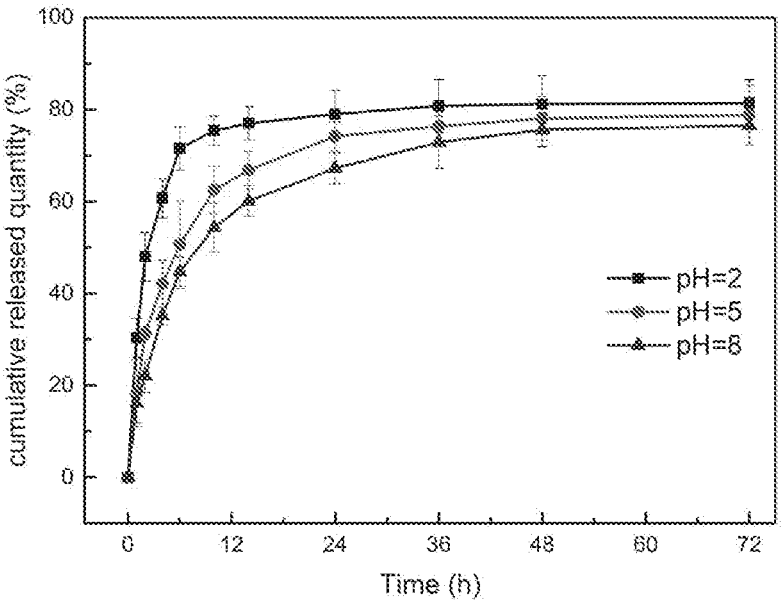
FIG. 4 is a kinetic curve of the release of the corrosion inhibitor in the prepared low-pH controlled-release intelligent corrosion inhibitor.
Figure 5:
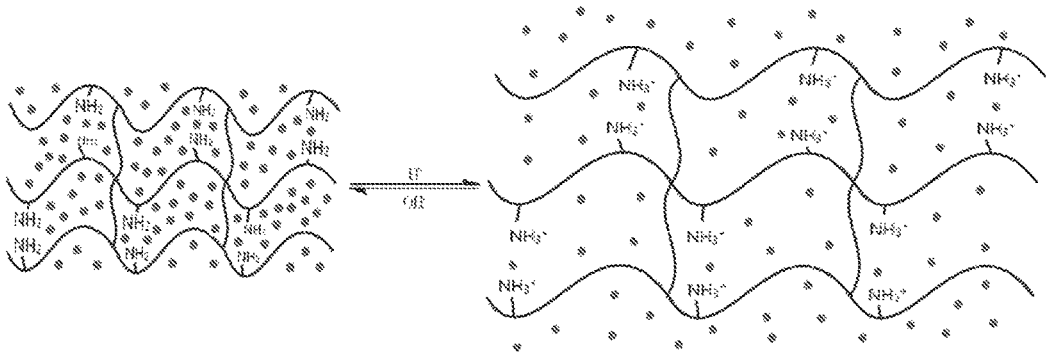
FIG. 5 is a principle diagram of chemical release in the prepared low-pH controlled-release intelligent corrosion inhibitor.
Figure 6:
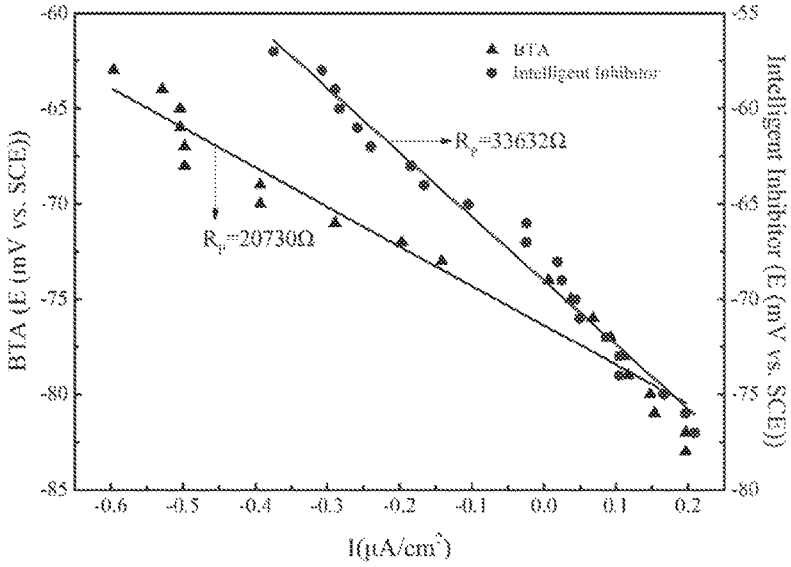
FIG. 6 is a fitted graph of polarization resistance $R_p$, obtained according to an electrochemical polarization curve after soaking Cu in a $Na_2SO_4$ solution at pH=2 for 1 h, in the presence of a low-pH controlled-release intelligent corrosion inhibitor and a conventional corrosion inhibitor.
Figure 7:
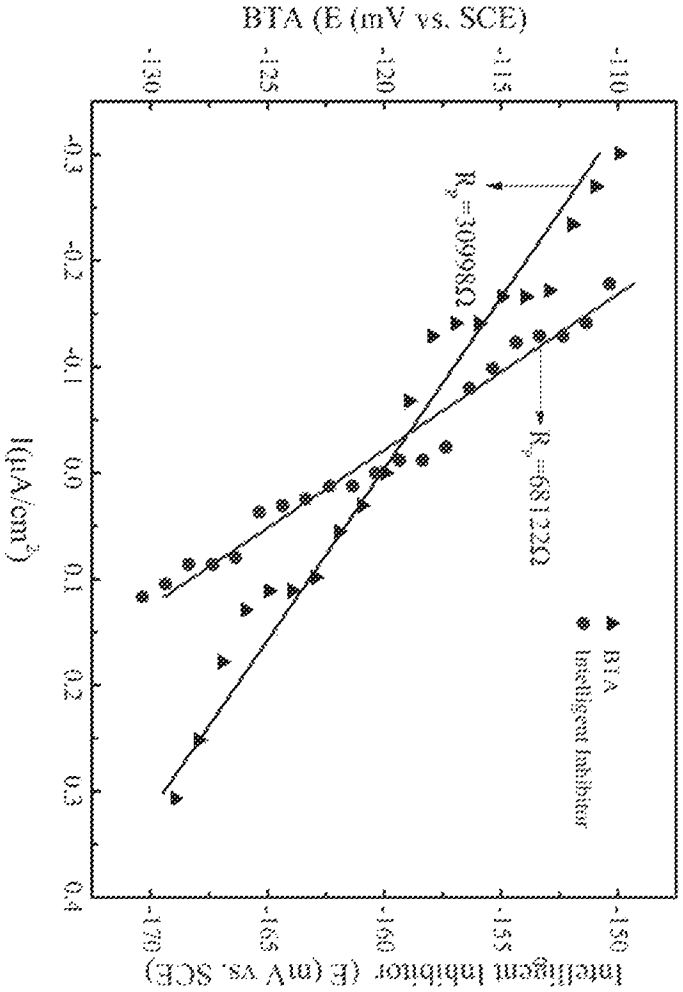
FIG. 7 is a fitted graph of polarization resistance $R_p$, obtained according to an electrochemical polarization curve after soaking Cu in a $Na_2SO_4$ solution at pH=2 for 4 h, in the presence of a low-pH controlled-release intelligent corrosion inhibitor and a conventional corrosion inhibitor.

The infrared spectrum demonstrated that: in comparison between the infrared spectrogram of the pH sensitive hydrogel (FIG. 3) and the infrared spectrogram of chitosan (FIG. 2), the stretching vibration peak of the primary amino group N—H was slightly narrowed, indicating that a part of amino groups on the molecular chain of chitosan participated in the reaction. A new absorption peak was present at 1560.62 $cm^{-1}$, which was the characteristic absorption peak of the functional group —C═N—, indicating the pH sensitive hydrogel contained —C═N— group and that Schiff reaction occurred in the process of preparation. There was no significant variation in other characteristic absorption peaks. The above conclusions demonstrated that the preparation of the pH sensitive hydrogel was successful.

Figure 8:
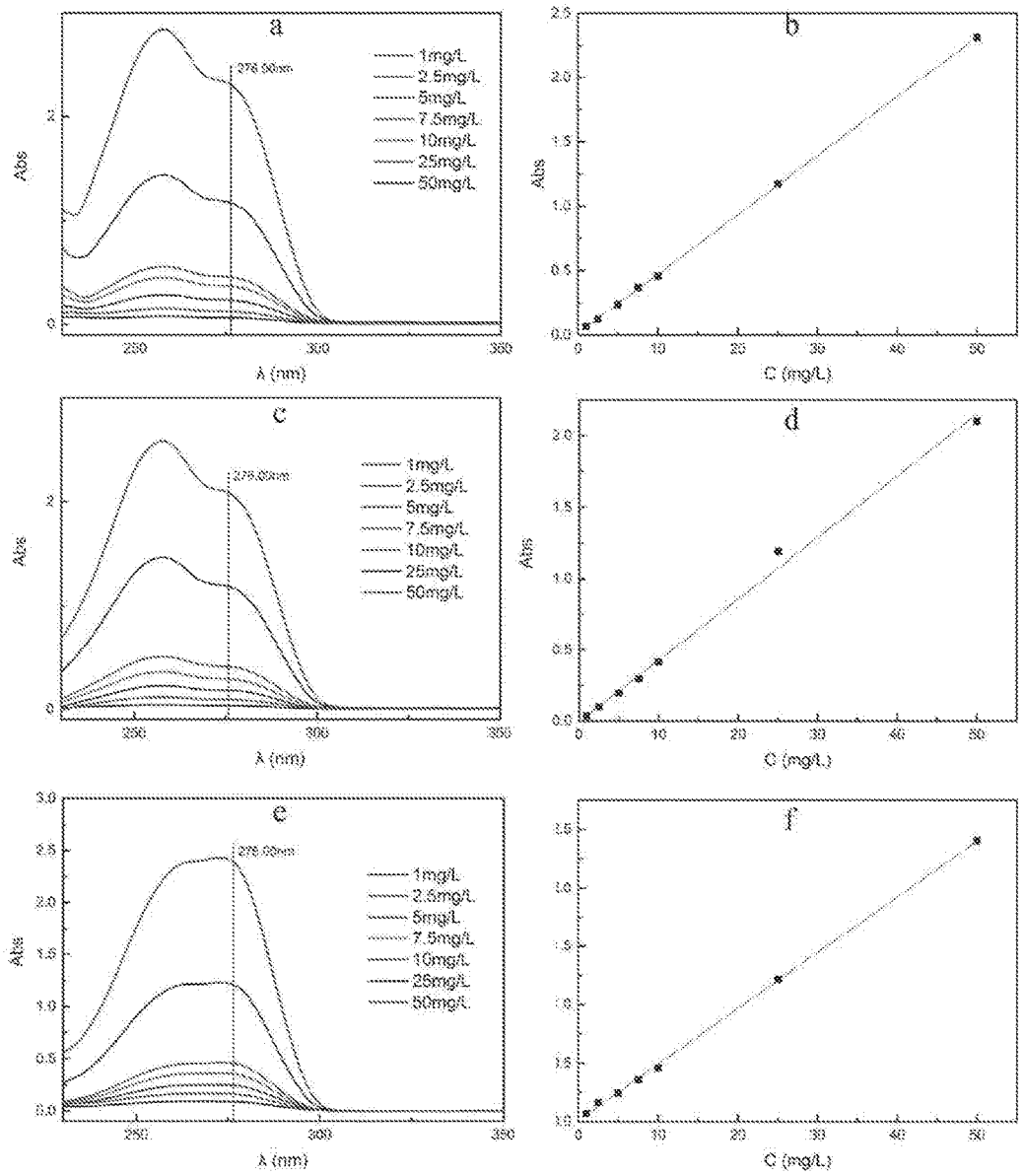
FIG. 8 is the BTA absorbance curves and concentration-absorbance standard curves in buffer solutions having different pH values, wherein pH=2:(a),(b); pH=5:(c),(d); pH=8:(e),(f) with regard to the chitosan hydrogel prepared according to Example 1.

The chemical releasing property of a corrosion inhibitor under conditions of different pH values is one of the important indications exhibiting its intelligence. In Example 1, the chemical releasing capacities of the corrosion inhibitor prepared according to Example 1 in buffer solutions having different pH values were tested. That is, the BTA absorbance curves and the concentration-absorbance standard curves in buffer solutions having different pH values (pH=2:(a),(b); pH=5:(c),(d); pH=8:(e),(f)) with regard to the chitosan hydrogel corrosion inhibitor prepared according to Example 1 were tested. The results were as follows:

The absorption spectra and concentration-absorbance curves of benzotriazole (BTA) in buffer solutions at pH=2, 5, and 8 were as shown in FIG. 8, and the peak positions and shapes of waves thereof were substantially similar to those of BTA in deionized water. A wave peak around 276 nm was selected as the characteristic absorption peak of BTA. Figs. b, d, and f were the standard curves of BTA in solutions at pH=2, 5, and 8 fitted according to absorbances at 276 nm under respective concentrations, respectively. The accuracies of the fitted curves were 99.98%, 99.40%, and 99.94% in this orders, and may be used to calculate the chemical releasing quantities of corrosion inhibitors.

Figure 9:
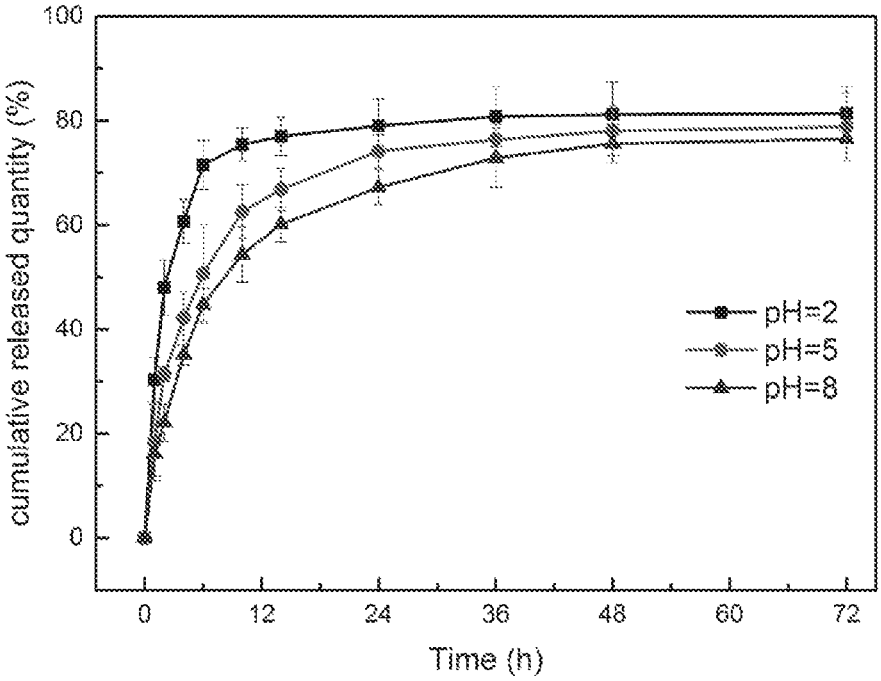
FIG. 9 is curves of cumulative released chemical quantities of the chitosan hydrogel corrosion inhibitor prepared according to Example 1 in buffer solutions.

The curves of cumulative chemical releasing rates of chitosan hydrogel corrosion inhibitors were as shown in FIG. 9. It can be seen from the figure that the concentrations of BTA in solutions rapidly increased within 24 h of the initial phase of soaking and then substantially maintained unchanged, which illustrated the process of chemical release of corrosion inhibitors. In three solution media, there were significant differences in releasing rates of BTA. The releasing rate significantly reduced as the pH value increased. At pH=2, the chemical releasing speed of the corrosion inhibitor was very fast and 60.70% would be achieved in about 4 h, and the chemical releasing rate significantly reduced after 24 h and the process of chemical release was substantially complete with a final chemical release quantity of about 81.38%. At pH=8, the chemical releasing rate of the corrosion inhibitor greatly reduced and the chemical releasing amount after 4 h was only 35.12%, and the chemical releasing rate significantly reduced after 48 h, which demonstrated that the process of chemical release was substantially complete, and the final chemical release quantity was about 76.46%. At pH=5, the releasing rate was between those described above, and the final chemical releasing amount was about 78.79%.

The above results showed that the chitosan hydrogel corrosion inhibitors obtained in Example 1 had excellent low-pH controlled-release properties of chemicals.

Example 2

1) Preparation of a pH-Sensitive Hydrogel a) 0.35 g of acetic acid was dropped into a beaker, 50 g deionized water was added, 0.9 g of chitosan powder was added with magnetically stirring at a speed of 500 r/min, and stirring was kept until being uniform followed by standing for 1 h to formulate an acetic acid solution of chitosan with a mass fraction of 1.8%. 25 g of an aqueous glutaraldehyde solution with a mass fraction of 1% was formulated, and transferred to the acetic acid solution of chitosan with magnetically stirring at a speed of 500 r/min, and the product was stirred for 30 min, and then placed in an oven at 30° C. for reaction by standing for 24 h.

b) After completion of the reaction, the product was cleaned with ethanol and deionized water, transferred to a freezer compartment of a refrigerator, frozen at −24° C. for 24 h, and immediately transferred to a vacuum lyophilizing oven, and then vacuum freeze-dried.

2) Preparation of a Low-pH Controlled-Release Intelligent Corrosion Inhibitor

About 0.8 g of the dry gel described above was taken and was soaked in 200 ml of an aqueous solution containing a BTA corrosion inhibiting substance with a BTA concentration of 1 g/L. After standing for 48 h, redundant aqueous BTA solution was removed, and the hydrogel carrying the corrosion inhibitor was cleaned with deionized water. After completion of cleaning, the product was transferred to a freezer compartment of a refrigerator, frozen at −24° C. for 24 h, immediately transferred to a vacuum lyophilizing oven, and vacuum freeze-dried, and then preserved by sealing for stand-by.

The infrared spectrum demonstrated that: in comparison between the infrared spectrogram of the pH sensitive hydrogel (FIG. 3) and the infrared spectrogram of chitosan (FIG. 2), the stretching vibration peak of the primary amino group N—H was slightly narrowed, indicating that a part of amino groups on the molecular chain of chitosan participated in the reaction. A new absorption peak was present at 1560.62 $cm^{-1}$, which was the characteristic absorption peak of the functional group —C═N—, indicating the pH sensitive hydrogel contained —C═N— group and that Schiff reaction occurred in the process of preparation. There was no significant variation in other characteristic absorption peaks. The above conclusions demonstrated that the preparation of the pH sensitive hydrogel was successful.

Tests of chemical releasing capacities were performed on the chitosan hydrogel corrosion inhibitors obtained in Example 2 in a manner similar to that of Example 1. The results showed that, similarly to those of Example 1, the chitosan hydrogel corrosion inhibitors obtained in Example 2 had excellent low-pH controlled-release properties of chemicals.

Example 3

1) Preparation of a pH-Sensitive Hydrogel a) 0.35 g of acetic acid was dropped into a beaker, 50 g deionized water was added, 0.6 g of chitosan powder was added with magnetically stirring at a speed of 500 r/min, and stirring was kept until being uniform followed by standing for 1 h to formulate an acetic acid solution of chitosan with a mass fraction of 1.2%. 25 g of an aqueous glutaraldehyde solution with a mass fraction of 2% was formulated, and transferred to the acetic acid solution of chitosan with magnetically stirring at a speed of 500 r/min, and the product was stirred for 30 min, and then placed in an oven at 30° C. for reaction by standing for 24 h.

b) After completion of the reaction, the product was cleaned with ethanol and deionized water, transferred to a freezer compartment of a refrigerator, frozen at −24° C. for 24 h, and immediately transferred to a vacuum lyophilizing oven, and then vacuum freeze-dried.

2) Preparation of a Low-pH Controlled-Release Intelligent Corrosion Inhibitor

About 0.8 g of the dry gel described above was taken and was soaked in 200 ml of an aqueous solution containing a BTA corrosion inhibiting substance with a BTA concentration of 5 g/L. After standing for 48 h, redundant aqueous BTA solution was removed, and the hydrogel carrying the corrosion inhibitor was cleaned with deionized water. After completion of cleaning, the product was transferred to a freezer compartment of a refrigerator, was frozen at −24° C. for 24 h, immediately transferred to a vacuum lyophilizing oven, and vacuum freeze-dried, and then preserved by sealing for stand-by.

The infrared spectrum demonstrated that: in comparison between the infrared spectrogram of the pH sensitive hydrogel (FIG. 3) and the infrared spectrogram of chitosan (FIG. 2), the stretching vibration peak of the primary amino group N—H was slightly narrowed, indicating that a part of amino groups on the molecular chain of chitosan participated in the reaction. A new absorption peak was present at 1560.62 $cm^{-1}$, which was the characteristic absorption peak of the functional group —C═N—, indicating the pH sensitive hydrogel contained —C═N— group and that Schiff reaction occurred in the process of preparation. There was no significant variation in other characteristic absorption peaks. The above conclusions demonstrated that the preparation of the pH sensitive hydrogel was successful.

Tests of chemical releasing capacities were performed on the chitosan hydrogel corrosion inhibitors obtained in Example 3 in a manner similar to that of Example 1. The results showed that, similarly to those of Example 1, the chitosan hydrogel corrosion inhibitors obtained in Example 3 had excellent low-pH controlled-release properties of chemicals.

Example 4

1) Preparation of a pH-Sensitive Hydrogel a) 0.35 g of acetic acid was dropped into a beaker, 50 g deionized water was added, 0.6 g of chitosan powder was added with magnetically stirring at a speed of 500 r/min, and stirring was kept until being uniform followed by standing for 1 h to formulate an acetic acid solution of chitosan with a mass fraction of 1.2%. 12.5 g of an aqueous glutaraldehyde solution with a mass fraction of 1% was formulated, and transferred to the acetic acid solution of chitosan with magnetically stirring at a speed of 500 r/min, and the product was stirred for 30 min, and then placed in an oven at 30° C. for reaction by standing for 24 h.

b) After completion of the reaction, the product was cleaned with ethanol and deionized water, transferred to a freezer compartment of a refrigerator, frozen at −24° C. for 24 h, and immediately transferred to a vacuum lyophilizing oven, and then vacuum freeze-dried.

2) Preparation of a Low-pH Controlled-Release Intelligent Corrosion Inhibitor

About 0.8 g of the dry gel described above was taken and was soaked in 200 ml of an aqueous solution containing a BTA corrosion inhibiting substance with a BTA concentration of 5 g/L. After standing for 48 h, redundant aqueous BTA solution was removed, and the hydrogel carrying the corrosion inhibitor was cleaned with deionized water. After completion of cleaning, the product was transferred to a freezer compartment of a refrigerator, frozen at −24° C. for 24 h, immediately transferred to a vacuum lyophilizing oven, and vacuum freeze-dried, and then preserved by sealing for stand-by.

The infrared spectrum demonstrated that: in comparison between the infrared spectrogram of the pH sensitive hydrogel (FIG. 3) and the infrared spectrogram of chitosan (FIG. 2), the stretching vibration peak of the primary amino group N—H was slightly narrowed, indicating that a part of amino groups on the molecular chain of chitosan participated in the reaction. A new absorption peak was present at 1560.62 $cm^{-1}$, which was the characteristic absorption peak of the functional group —C═N—, indicating the pH sensitive hydrogel contained —C═N— group and that Schiff reaction occurred in the process of preparation. There was no significant variation in other characteristic absorption peaks. The above conclusions demonstrated that the preparation of the pH sensitive hydrogel was successful.

Tests of chemical releasing capacities were performed on the chitosan hydrogel corrosion inhibitors obtained in Example 4 in a manner similar to that of Example 1. The results showed that, similarly to those of Example 1, the chitosan hydrogel corrosion inhibitors obtained in Example 4 had excellent low-pH controlled-release properties of chemicals.

What is claimed is:

1. A preparation method of a low-pH controlled-release corrosion inhibitor, comprising the steps of:

(a) dissolving a monomer in an aqueous solution of an acidic medium with a mass fraction of 0.5-1.0% to prepare a monomer-acidic medium aqueous solution wherein said monomer has a mass fraction of 1.2%-1.8%, then adding an aqueous solution of a crosslinking agent with a mass fraction of 1%-2% to said monomer-acidic medium aqueous solution, and stirring and reacting, wherein said monomer is chitosan, said acidic medium is acetic acid, and said crosslinking agent is glutaraldehyde;

(b) cooling, washing, freezing, and drying the product prepared in step (a) to obtain a pH-responsive hydrogel; and (c) adding said pH-responsive hydrogel into an aqueous solution of a corrosion inhibiting substance having a concentration of 1-5 mg/mL, and then lyophilizing in vacuum to prepare said low-pH controlled-release corrosion inhibitor, wherein said corrosion inhibiting substance is benzotriazole, wherein said low pH is 2-5.

2. The preparation method of the low-pH controlled-release corrosion inhibitor according to claim 1, wherein said step (a) comprises:

formulating the aqueous solution of said acidic medium with a mass fraction of 0.5-1.0%, then dissolving said monomer in said aqueous solution, uniformly stirring and standing to prepare a monomer-acidic medium aqueous solution wherein said monomer has a mass fraction of 1.2%-1.8%, then adding an aqueous solution of the crosslinking agent with a mass fraction of 1%-2% into said monomer-acidic medium aqueous solution, continuously stirring the obtained mixture at a speed of 1000-1500 rotations/min for 20-30 min, and reacting at 30-35° C. for 24-28 h.

3. The preparation method of the low-pH controlled-release corrosion inhibitor according to claim 1, wherein said step (b) comprises:

cooling the product prepared in step (a) to room temperature, then washing the product with ethanol and deionized water, freezing the washed product at −25 to −20° C. for 24-28 h, and then lyophilizing in vacuum to constant weight, to obtain the pH-responsive hydrogel.

4. The preparation method of the low-pH controlled-release corrosion inhibitor according to claim 1, wherein said step (c) comprises:

adding said pH-responsive hydrogel into the aqueous solution of said corrosion inhibiting substance having a concentration of 1-5 mg/mL, soaking for 2-3 days, freezing at −25 to −20° C. for 24-28 h, and then lyophilizing in vacuum to a constant weight, to prepare said low-pH controlled-release corrosion inhibitor.

* * * * *